US009905941B2

(12) United States Patent
Tago et al.

(10) Patent No.: US 9,905,941 B2
(45) Date of Patent: Feb. 27, 2018

(54) WIRE WITH CRIMPED TERMINAL, WIRE HARNESS, AND CRIMPED TERMINAL

(71) Applicants: AUTONETWORKS TECHNOLOGIES, LTD, Mie (JP); SUMITOMO WIRING SYSTEMS, LTD., Mie (JP); SUMITOMO ELECTRIC INDUSTRIES, LTD., Osaka (JP)

(72) Inventors: Hiromitsu Tago, Mie (JP); Takanobu Shimada, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 15/248,658

(22) Filed: Aug. 26, 2016

(65) Prior Publication Data

US 2017/0077618 A1 Mar. 16, 2017

(30) Foreign Application Priority Data

Sep. 16, 2015 (JP) ..... 2015-182692

(51) Int. Cl.

| | |
|---|---|
| ***H01R 4/18*** | (2006.01) |
| *H01R 43/048* | (2006.01) |
| *H01R 43/16* | (2006.01) |

(52) U.S. Cl.

CPC ..... *H01R 4/185* (2013.01)

(58) Field of Classification Search

CPC ..... H01R 4/185; H01R 4/62; H01R 43/048; H01R 4/20; H01R 4/188; H01R 43/16; H01R 4/184; H01R 4/183; H01R 4/18

(Continued)

(56) References Cited

U.S. PATENT DOCUMENTS 4,545,638 A * 10/1985 Neidich ..... H01R 13/111 439/723
5,082,462 A * 1/1992 Oswald, Jr. ..... H01R 13/111 439/380

(Continued)

FOREIGN PATENT DOCUMENTS

JP 2015-076237 4/2015

*Primary Examiner* — Amy Cohen Johnson
*Assistant Examiner* — Matthew T Dzierzynski
(74) *Attorney, Agent, or Firm* — Greenblum & Bernstein, P.L.C.

(57) ABSTRACT

A wire with crimped terminal is provided with a wire and a crimped terminal connected to a terminal portion of the wire. The crimped terminal is provided with a board-shaped base portion where the wire is arranged; a counterpart member connector provided at a forefront end of the base portion; a pair of core wire crimp tabs crimped to a core wire portion of the wire; and a pair of sheath crimp tabs crimped to an insulated sheath portion of the wire. The core wire crimp tabs are each provided with an inwardly-recessed contracted portion on both sides of the core wire crimp tab in an X axis direction, in an area closer to the base portion than a leading edge portion of the core wire crimp tab, the contracted portion thereby having a smaller width in the X axis direction.

7 Claims, 4 Drawing Sheets

(58) Field of Classification Search
USPC ..... 439/877, 878
See application file for complete search history.

(56) References Cited

U.S. PATENT DOCUMENTS

| | | | | | |
|---|---|---|---|---|---|
| 5,532,433 | A * | 7/1996 | Endo | H01R 4/20 | 174/77 R |
| 6,132,239 | A * | 10/2000 | N.ae butted.rland | H01R 4/26 | 439/439 |
| 6,942,528 | B2 * | 9/2005 | Brake | H01R 13/113 | 439/275 |
| 7,690,954 | B2 * | 4/2010 | Watanabe | H01R 4/185 | 439/730 |
| 7,722,416 | B2 * | 5/2010 | Gump | H01R 4/188 | 439/879 |
| 8,070,536 | B2 * | 12/2011 | Ono | H01R 4/185 | 439/877 |
| 2003/0024117 | A1 * | 2/2003 | Engeser | H01R 43/0221 | 29/860 |
| 2010/0055998 | A1 * | 3/2010 | Aihara | H01R 4/185 | 439/877 |
| 2011/0177728 | A1 * | 7/2011 | Uchiyama | H01R 43/048 | 439/877 |
| 2013/0035007 | A1 * | 2/2013 | Onuma | H01R 43/16 | 439/877 |

* cited by examiner

WIRE WITH CRIMPED TERMINAL, WIRE HARNESS, AND CRIMPED TERMINAL

CROSS-REFERENCE TO RELATED APPLICATIONS

The present application claims priority under 35 U.S.C. § 119 of Japanese Application No. 2015-182692, filed on Sep. 16, 2016, the disclosure of which is expressly incorporated by reference herein in its entirety.

BACKGROUND OF THE INVENTION

Field of the Invention

This invention is related to a crimped terminal connected to a terminal portion of a wire.

Japanese Patent Laid-open Publication No. 2015-76237 discloses a crimped terminal connected to a wire. This crimped terminal includes a core wire crimped portion that crimps to a core wire of the wire, the core wire being configured with a plurality of wire strands. In addition, in an intermediate area in an axial direction of the core wire of the core wire crimped portion, a notch is provided opening into a direction perpendicular to the axial direction.

According to this crimped terminal, having the notch in the core wire crimped portion allows two edges of the notch to bite into the core wire when the core wire crimped portion is crimped. This results in an area that prevents the core wire from stretching, providing an area where a contracting force is effectively applied to the core wire. Thus, a new area is created due to the stretching of each of the wire strands, promoting adhesion due to effective application of contracting force to each of the wire strands, thereby improving conductivity between each of the wire strands. As a result, electrical resistance at an electrical connection point is reduced.

However, with the conventional crimped terminal (including the crimped terminal shown in Japanese Patent Laid-open Publication No. 2015-76237), when the core wire crimped portion is swaged and crimped, the core wire crimped portion stretches in the axial direction of the core wire. As the core wire crimped portion stretches in the axial direction, the entire terminal stretches in the axial direction. When the crimped terminal is stretched, the wire having the crimped terminal sometimes requires changes to the assembly layout, for example. For instance, when the forefront end of the crimped terminal is inserted into a connector housing, the crimped terminal sometimes sticks out from the housing exceeding a predetermined amount, due to the stretching of the crimped terminal. Thus, this requires changes to the connector design, for example.

SUMMARY OF THE INVENTION

The present invention provides a technology that inhibits a crimped terminal from stretching during a crimping process.

In order to achieve the objective mentioned above, a wire with crimped terminal is provided with a wire and a crimped terminal connected to a terminal portion of the wire. The crimped terminal is provided with a board-shaped base portion facing a wiring area where the wire is arranged; a counterpart member connector provided at a forefront end of the base portion and conductively connecting to a counterpart member; and a core wire crimp tab provided toward a base end side of the base portion with respect to the counterpart member connector, extending from a side of the base portion in a width direction, and crimped to a core wire portion of the wire arranged on the base portion while the tab is bent inwardly toward the base portion. The core wire crimp tab is provided with an inwardly-recessed contracted portion on at least one of two sides of the core wire crimp tab in a length direction of the base portion, in an area closer to the base portion than a leading edge portion of the core wire crimp tab, the contracted portion thereby having a smaller width in the length direction.

In the wire with crimped terminal, the crimped terminal includes a sheath crimp tab provided toward the base end side of the base portion with respect to the core wire crimp tab, extending from a side of the base portion in a width direction, and crimped to an insulated sheath portion of the wire arranged on the base portion while the tab is bent inwardly toward the base portion.

In the wire with crimped terminal, the contracted portion is an inwardly recessed portion on two sides of the core wire crimp tab in the length direction.

In the wire with crimped terminal, the contracted portion is provided in a borderline area with the base portion of the core wire crimp tab.

A wire harness is provided with a plurality of wires with crimped terminals, each having a crimped terminal attached to a terminal portion of a wire. The crimped terminal attached to the wire is provided with a board-shaped base portion facing a wiring area where the wire is arranged; a counterpart member connector provided at a forefront end of the base portion and conductively connecting to a counterpart member; and a core wire crimp tab provided toward a base end side of the base portion with respect to the counterpart member connector, extending from a side of the base portion in a width direction, and crimped to a core wire portion of the wire arranged on the base portion while the tab is bent inwardly toward the base portion. The core wire crimp tab is provided with an inwardly-recessed contracted portion on at least one of two sides of the core wire crimp tab in a length direction of the base portion, in an area closer to the base portion than a leading edge portion of the core wire crimp tab, the contracted portion thereby having a smaller width in the length direction.

A crimped terminal is provided attached to a terminal portion of a wire, the crimped terminal being formed with a conductive material. The crimped terminal is provided with a board-shaped base portion facing a wiring area where the wire is arranged; a counterpart member connector provided at a forefront end of the base portion and conductively connecting to a counterpart member; and a core wire crimp tab provided toward a base end side of the base portion with respect to the counterpart member connector, extending from a side of the base portion in a width direction, and crimped to a core wire portion of the wire arranged on the base portion while the tab is bent inwardly toward the base portion. The core wire crimp tab is provided with an inwardly-recessed contracted portion on at least one of two sides of the core wire crimp tab in a length direction of the base portion, in an area closer to the base portion than a leading edge portion of the core wire crimp tab, the contracted portion thereby having a smaller width in the length direction.

According to the wire with crimped terminal, since the contracted portion is provided to the core wire crimp tab of the crimped terminal, when the core wire crimp tab is crimped to the core wire portion, stretching at the contracted portion and the base end portion near the contracted portion is inhibited as a portion at the core wire crimp tab toward the leading edge portion relative to the contracted portion stretches in the length direction. Further, since the contracted portion has a small width, the stretching amount is relatively small. According to these features, since the stretching amount on the base end portion of the core wire crimp tab is reduced, it becomes possible to reduce the stretching amount of the crimped terminal itself.

Furthermore, according to the wire with crimped terminal, since the sheath crimp tab crimps to the sheathed portion of the wire, the sheath crimp tab can supplement a fixation strength of the core wire crimp tab with respect to the wire that is lowered, due to the core wire crimp tab having the contracted portion.

Furthermore, according to the wire with crimped terminal, the base portion is inhibited from stretching in both length directions.

Furthermore, according to the wire with crimped terminal, by having the contracted portion in the borderline area with the base portion of the core wire crimp tab, it becomes possible to effectively inhibit the base portion from stretching as the leading edge portion of the core wire crimp tab stretches.

Furthermore, according to the wire harness, since the contracted portion is provided to the core wire crimp tab of the crimped terminal, when the core wire crimp tab is crimped to the core wire portion, stretching at the contracted portion and the base end portion near the contracted portion is inhibited as a portion at the core wire crimp tab toward the leading edge portion relative to the contracted portion stretches in the length direction. Further, since the contracted portion has a small width, the stretching amount is relatively small. According to these features, since the stretching amount on the base end portion of the core wire crimp tab is reduced, it becomes possible to reduce the stretching amount of the crimped terminal itself.

Furthermore, according to the wire with crimped terminal, since the contracted portion is provided to the core wire crimp tab of the crimped terminal, when the core wire crimp tab is crimped to the core wire portion, stretching at the contracted portion and the base end portion near the contracted portion is inhibited as a portion at the core wire crimp tab toward the leading edge portion relative to the contracted portion stretches in the length direction. Further, since the contracted portion has a small width, the stretching amount is relatively small. According to these features, since the stretching amount on the base end portion of the core wire crimp tab is reduced, it becomes possible to reduce the stretching amount of the crimped terminal itself.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE INVENTION

Figure 1:
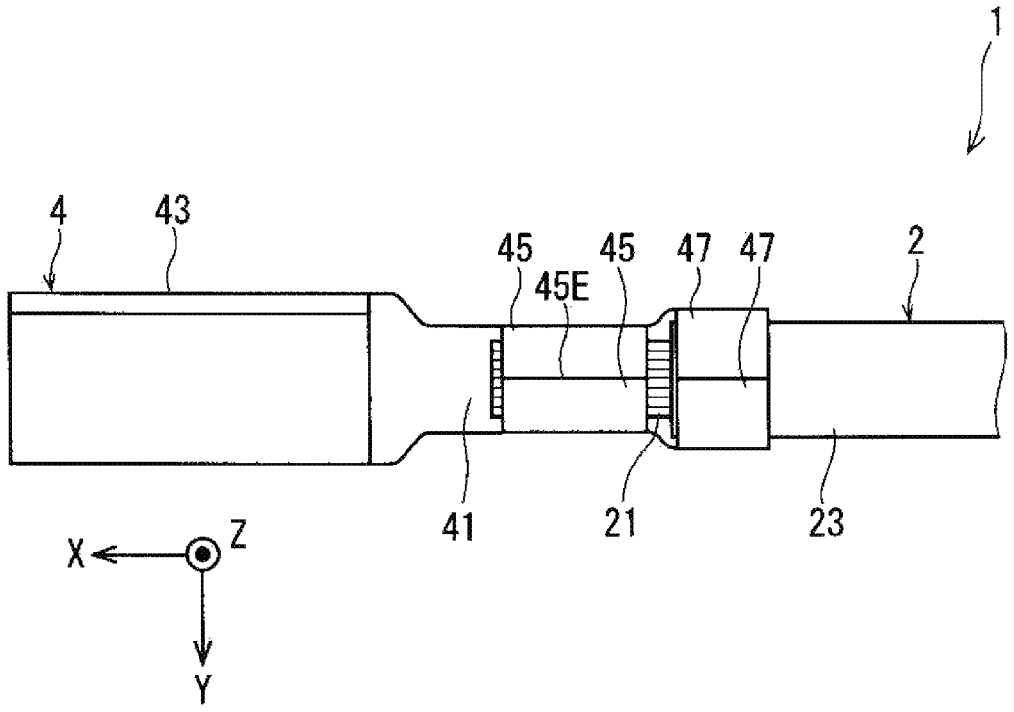
FIG. 1 is a schematic plan view illustrating a wire with a crimped terminal according to a first embodiment of the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the forms of the present invention may be embodied in practice.

Hereafter, embodiments of the present invention are described with reference to the drawings. The configuration elements described in the following embodiments are provided as examples only, and they are not intended limit the scope of the invention to the particulars disclosed herein. Moreover, in the drawings, dimensions and numbers of various portions may be represented in an exaggerated or simplified form as necessary in order to facilitate understanding.

First Embodiment

Figure 2:
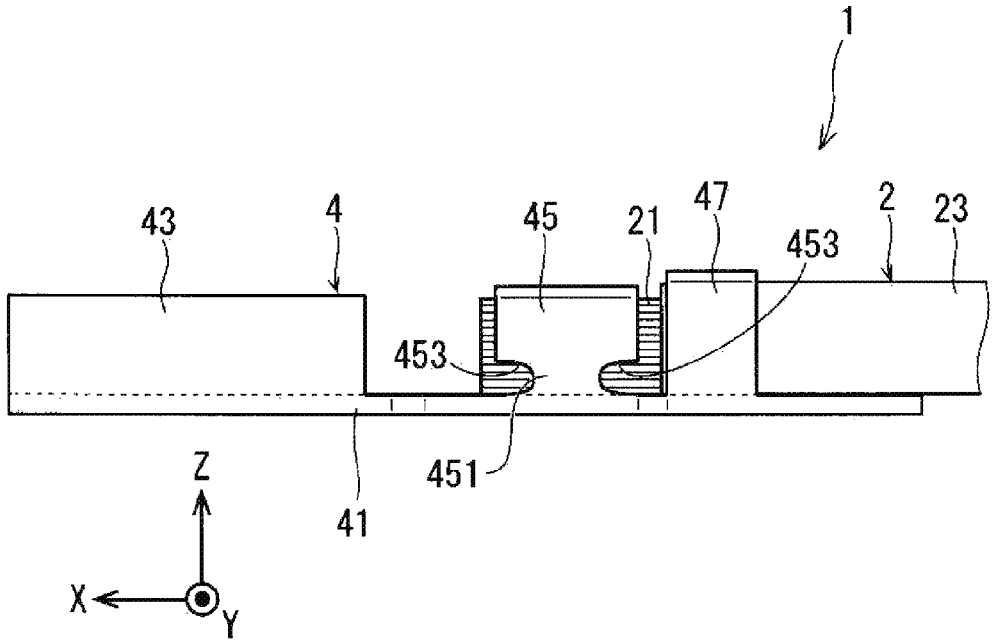
FIG. 2 is a schematic side view illustrating the wire with the crimped terminal according to the first embodiment of the invention.
Figure 3:
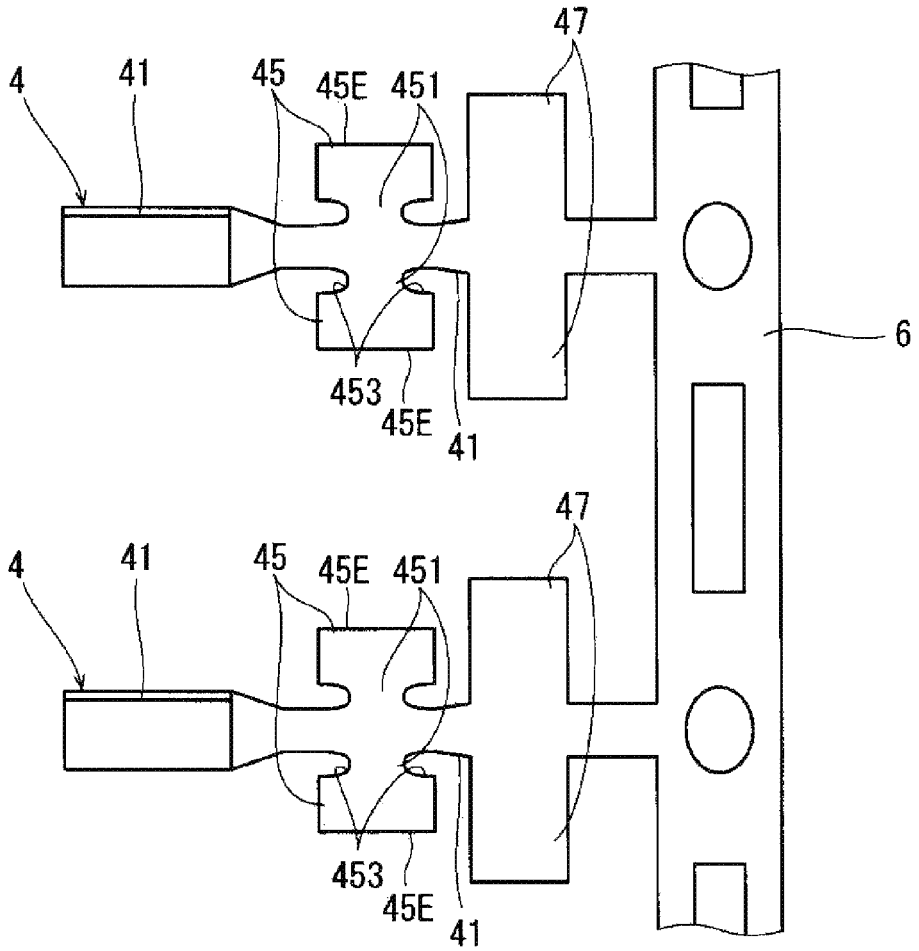
FIG. 3 is a schematic plan view illustrating the crimped terminal prior to being crimped to a wire according to the first embodiment of the invention.

FIG. 1 is a schematic plan view illustrating a wire with crimped terminal 1 according to a first embodiment of the invention. FIG. 2 is a schematic plan view illustrating the wire with crimped terminal 1 according to the first embodiment of the invention. FIG. 3 is a schematic plan view illustrating a crimped terminal 4 prior to being crimped to a wire 2 according to the first embodiment of the invention.

The wire with crimped terminal 1 includes the wire 2 and the crimped terminal 4 connected to a terminal portion of the wire 2.

The wire 2 includes a core wire portion 21 and an insulated sheath portion 23. The core wire portion 21 is configured with a plurality of wire strands made of a conductive metal such as aluminum, aluminum alloy, copper, or copper alloy, for example. The insulated sheath portion 23 is formed with non-conductive material (e.g., resin) that surrounds an outer circumference of the core wire portion 21. At the terminal portion of the wire 2, the insulating sheath portion 23 is stripped off and the core wire portion 21 is exposed.

The crimped terminal 4 is a member formed with conductive material principally composed of metal, such as copper, tin, or the like. The crimped terminal 4 includes a base portion 41, a counterpart member connector 43, a pair of core wire crimp tabs 45, and a pair of sheath crimp tabs 47. As shown in FIG. 3, the crimped terminal 4 prior to being crimped to the wire 2 is connected at a base end side thereof to one side of a linking band 6. On the side of the linking band 6, a plurality of crimped terminals 4 are aligned in parallel with an even pitch. In order for the wire 2 to be arranged in the base portion 41, the pair of core wire crimp tabs 45 and the pair of sheath crimp tabs 47 are formed so as to be open to a surface where the wire 2 is arranged in the base portion 41. Each of the crimped terminals 4 is cut off the linking band 6 at an appropriate timing prior to, during, or after being crimped to the wire 2.

In the following explanation, a length direction of the base portion 41 is considered as an X axis direction, and a width direction of the base portion 41 (direction orthogonal to the length direction) is considered as a Y axis direction. In addition, a direction in which the pair of core wire crimp tabs 45 stand upward from the base portion 41 in a crimped state is considered as a Z axis direction.

The base portion 41 is a board shaped portion having a wiring portion facing a wiring area where the terminal portion of the wire 2 is arranged.

The counterpart member connector 43 is provided at a forefront end of the base portion 41, and is connected conductively to a counterpart member. In this example, the counterpart member connector 43 is configured as a long-rectangular tube portion. When the counterpart member (in this example, a male terminal) is inserted inward from the forefront end of the tube portion, the counterpart member and the crimped terminal 4 are conductively connected.

While not shown in the drawings, a plurality of wires with crimped terminals 1 are bound together to configure a wire harness. At this time, some of the connectors to counterpart members 43 to the crimped terminals 4 attached at an end of each of the wires with crimped terminals 1 are housed within a housing of one connector, configuring a single connector terminal portion.

In addition, counterparts to be connected at the counterpart member connector of the crimped terminal according to the present invention are not limited to terminals. For example, a counterpart member connector may be configured to allow conductive connection with a ground point, which is a part of a vehicle body (e.g., automotive body). In this case, the crimped terminal acts as a ground terminal. Thus, the counterpart member connector may include an insertion hole for inserting a bolt that fixates the connector to the ground point, for example.

The pair of core wire crimp tabs 45 are provided on the base end side (−X side) of the base portion 41 with respect to the counterpart member connector 43. The pair of core wire crimp tabs 45 are provided in an intermediate portion of the base portion 41 in the length direction (X axis direction), each extending from two sides in a width direction (Y axis direction) orthogonal to the length direction. In other words, prior to the crimping process, the pair of core wire crimp tabs 45 extend in the Y axis direction (width direction of the base portion 41) as shown in FIG. 3. After the crimping process, the pair of core wire crimp tabs 45 extend from the base portion 41 in the Z axis direction as shown in FIG. 1. The pair of core wire crimp tabs 45 are bent inwards during the crimping process and crimped to the core wire portion 21 of the wire 2 aligned in the base portion 41. However, it is not necessary to provide the pair of core wire crimp tabs 45 on both sides of the base portion 41. For example, only one core wire crimp tab 45 may be provided on one side of the base portion 41. In addition, it is possible to provide a plurality of core wire crimp tabs on one or both sides of the base portion 41, the tabs having a predetermined distance therebetween in the length direction.

Each of the pair of core wire crimp tabs 45 has a contracted portion 451. As shown in FIG. 2, the contracted portion 451 is configured with notches 453 on both sides thereof in the X axis direction (length direction of the base portion 41). Accordingly, the contracted portion 451 contracts both sides of the core wire crimp tab 45 inward, thereby providing a narrower width for the core wire crimp tab 45 along the X axis direction. However, it is not necessary to provide the notches 453 on both sides of the core wire crimp tab 45. For example, only one notch 453 may be provided on either one side of the core wire crimp tab 45. Moreover, it is possible to provide a plurality of notches inwardly contracting one or both sides of the core wire crimp tab 45.

The pair of sheath crimp tabs 47 are provided toward the base end side with respect to the core wire crimp tabs 45 on the base portion 41. The pair of sheath crimp tabs 47 are crimped to the insulated sheath portion 23 of the wire 2 aligned in the width direction (Y axis direction) of the base portion 41. Each of the pair of sheath crimp tabs 47 extends from both side portions of the base portion 41 in the Y axis direction. The pair of sheath crimp tabs 47 are bent inwards during the crimping process and crimped to the insulated sheath portion 23 of the wire 2. However, it is not necessary to provide the crimped terminal 4 with the pair of sheath crimp tabs 47, and the sheath crimp tabs 47 may be omitted.

When the core wire crimp tab 45 of the crimped terminal 4 is crimped to the core wire portion 21 of the wire 2, a portion of the core wire crimp tab 45 toward the leading edge portion relative to the contracted portion 451 stretches in the X axis direction (length direction of the base portion 41). As the leading edge portion of the core wire crimp tab 45 stretches in the X axis direction, a base end portion of the core wire crimp tab 45 (side connecting with the base portion 41) also stretches in the X axis direction. However, in the present embodiment, since the contracted portion 451 is provided, the leading edge portion and the base end portion of the core wire crimp tab 45 are separated. Further, since the contracted portion 451 has a narrower width, the stretching amount is relatively small. According to these features, since the stretching amount on the base end portion of the core wire crimp tab 45 is reduced, it becomes possible to reduce the stretch in the length direction of the base portion 41. Accordingly, it becomes possible to inhibit the overall stretching of the crimped terminal 4 itself. Especially, in the present embodiment, since the contracted portion 451 is inwardly recessed on both sides of the core wire crimp tab 45, it becomes possible to inhibit stretching of the base portion 41 in both X axis directions (+X and −X directions). Accordingly, it becomes possible to inhibit stretching of the crimped terminal 4 in both X axis directions.

In addition, in the present embodiment, the contracted portion 451 is provided to a borderline area between the base portion 41 and the core wire crimp tab 45. Therefore, it becomes possible to effectively inhibit the base portion 41 from stretching as a leading edge portion 45E of the core wire crimp tab 45 stretches. However, the contracted portion 451 is not required to be formed in the borderline area. In other words, it is sufficient that the contracted portion 451 is provided at least closer to the base portion 41 than the leading edge portion 45E of the core wire crimp tab 45.

Furthermore, since the crimped terminal 4 has the sheath crimp tab 47 that crimps to the sheathed portion of the wire, the sheath crimp tab 47 can supplement a fixation strength of the core wire crimp tab 45 with respect to the wire 2 that is lowered, due to the core wire crimp tab 45 having the contracted portion 451.

Second Embodiment

Next, a second embodiment of the present invention is described. In the following example, configuration elements that are similar to those already described are indicated using the same reference numerals or with alphabetic characters appended to the reference numerals, and the detailed explanation thereof is omitted.

Figure 4:
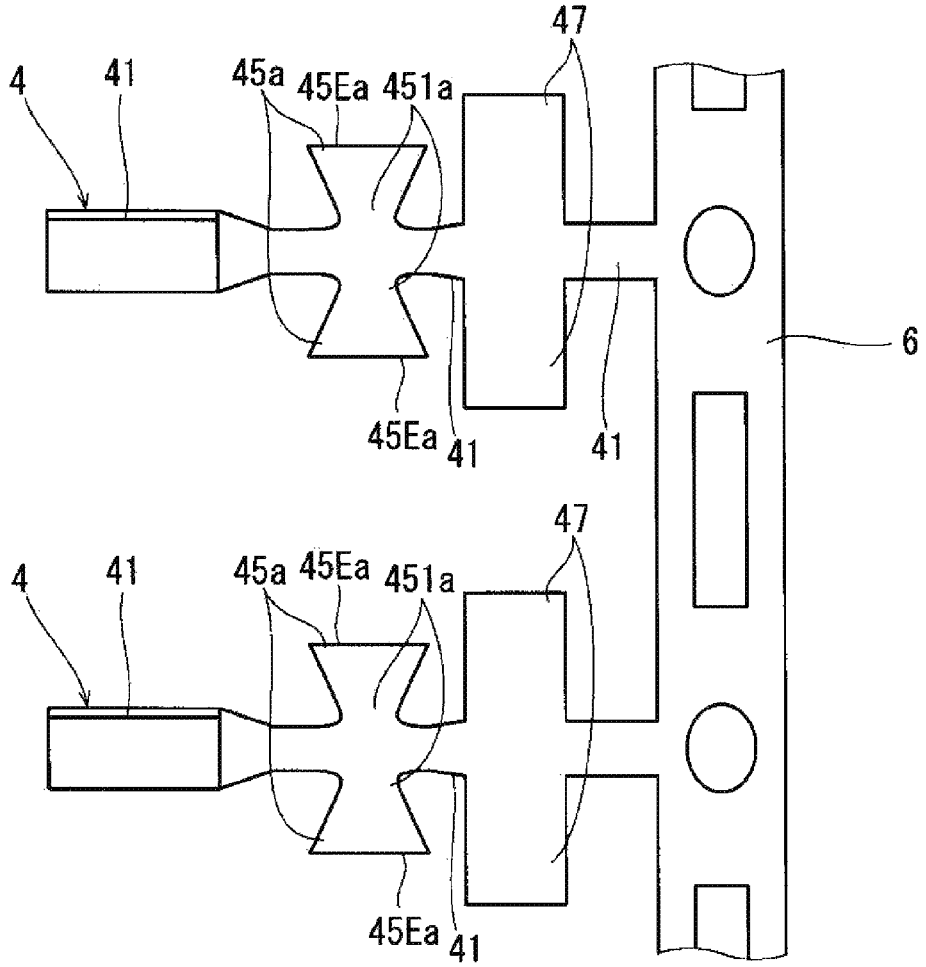
FIG. 4 is a schematic plan view illustrating a crimped terminal prior to being crimped to a wire according to a second embodiment of the invention.

FIG. 4 is a schematic plan view illustrating a crimped terminal 4*a* prior to being crimped to the wire 2 according to the second embodiment of the invention. FIG. 4 illustrates the crimped terminal 4*a* prior to being crimped to the wire 2. In the crimped terminal 4*a* according to the present embodiment, a core wire crimp tabs 45*a* is provided in an intermediate portion of the base portion 41. Similar to the core wire crimp tab 45 in the first embodiment, the core wire crimp tab 45*a* has a contracted portion 451*a* inwardly recessed on both sides in the X axis direction. In more detail, in a direction approaching the base portion 41 from the leading edge portion 45Ea, the core wire crimp tab 45*a* has a gradually narrowing width in the X axis direction. In a borderline area with the base portion 41, the core wire crimp tab 45*a* has the narrowest width.

Also with respect to the crimped terminal 4*a* according to the present embodiment, with the core wire crimp tab 45*a* inwardly contracting on both sides, it becomes possible to inhibit the base portion 41 from stretching as a leading edge portion 45Ea of the core wire crimp tab 45*a* stretches. Accordingly, it becomes possible to inhibit stretching of the crimped terminal 4 during the crimping process.

In the above, the present invention is described in detail. However, the above description is in all respects exemplary and the present invention is not limited by the description. Numerous modifications not given as examples are understood to be conceivable without departing from the scope of the present invention. Moreover, each configuration described in the above-noted embodiments and various modified examples can be combined or omitted as appropriate to the extent that such combination or exclusion is not mutually contradictory.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above described embodiments, and various variations and modifications may be possible without departing from the scope of the present invention.

What is claimed is:

1. A wire with crimped terminal comprising a wire and a crimped terminal connected to a terminal portion of the wire, wherein the crimped terminal comprises:

a board-shaped base portion having a wiring portion that faces a wiring area where the wire is arranged;

a counterpart member connector provided at a forefront end of the base portion and conductively connecting to a counterpart member; and a core wire crimp tab provided toward a base end side of the base portion with respect to the counterpart member connector, extending from a side of the base portion in a width direction, and crimped to a core wire portion of the wire arranged on the base portion while the tab is bent inwardly toward the base portion, wherein the core wire crimp tab is provided with an inwardly-recessed contracted portion on at least one of two sides of the core wire crimp tab in a length direction of the base portion, in an area closer to the base portion than a leading edge portion of the core wire crimp tab, the contracted portion thereby having a smaller width in the length direction than the leading edge portion, wherein the contracted portion is defined by at least one recess having an opened first end and a closed second end, and wherein a recessed direction from the opened first end towards the closed second end extends in the length direction.

2. The wire with crimped terminal according to claim 1, wherein the crimped terminal further comprises:

a sheath crimp tab provided toward the base end side of the base portion with respect to the core wire crimp tab, extending from a side of the base portion in a width direction, and crimped to an insulated sheath portion of the wire arranged on the base portion while the tab is bent inwardly toward the base portion.

3. The wire with crimped terminal according to claim 1, wherein the contracted portion is an inwardly recessed portion on both sides of the core wire crimp tab in the length direction.

4. The wire with crimped terminal according to claim 1, wherein the contracted portion is provided in a borderline area with the base portion of the core wire crimp tab.

5. A wire harness having a plurality of wires with crimped terminals, each having a crimped terminal attached to a terminal portion of a wire, wherein the crimped terminal attached to the wire comprises:

a board-shaped base portion having a wiring portion that faces a wiring area where the wire is arranged;

a counterpart member connector provided at a forefront end of the base portion and conductively connecting to a counterpart member; and a core wire crimp tab provided toward a base end side of the base portion with respect to the counterpart member connector, extending from a side of the base portion in a width direction, and crimped to a core wire portion of the wire arranged on the base portion while the tab is bent inwardly toward the base portion, wherein the core wire crimp tab is provided with an inwardly-recessed contracted portion on at least one of two sides of the core wire crimp tab in a length direction of the base portion, in an area closer to the base portion than a leading edge portion of the core wire crimp tab, the contracted portion thereby having a smaller width in the length direction than the leading edge portion, wherein the contracted portion is defined by at least one recess having an opened first end and a closed second end, and wherein a recessed direction from the opened first end towards the closed second end extends in the length direction.

6. A crimped terminal attached to a terminal portion of a wire, the crimped terminal being formed with a conductive material, and comprising:

a board-shaped base portion having a wiring portion that faces a wiring area where the wire is arranged;

a counterpart member connector provided at a forefront end of the base portion and conductively connecting to a counterpart member; and a core wire crimp tab provided toward a base end side of the base portion with respect to the counterpart member connector, extending from a side of the base portion in a width direction, and crimped to a core wire portion of the wire arranged on the base portion while the tab is bent inwardly toward the base portion, wherein the core wire crimp tab is provided with an inwardly-recessed contracted portion on at least one of two sides of the core wire crimp tab in a length direction of the base portion, in an area closer to the base portion than a leading edge portion of the core wire crimp tab, the contracted portion thereby having a smaller width in the length direction than the leading edge portion, wherein the contracted portion is defined by at least one recess having an opened first end and a closed second end, and wherein a recessed direction from the opened first end towards the closed second end extends in the length direction.

7. The wire with crimped terminal according to claim 2, wherein the board-shaped base portion has a lower side portion that is uniformly flat along the length direction of the base portion, and the core wire crimp tab and the sheath crimp tab extend from the lower side of the base portion.

* * * * *